US005086514A

United States Patent [19]

Ross

[11] Patent Number: 5,086,514

[45] Date of Patent: Feb. 11, 1992

[54] INFLATABLE PROTECTIVE CUSHION TO BE WORN BY PEOPLE IN HIGH SPEED AND HIGH IMPACT SPORTS

[76] Inventor: Gary Ross, 140 Oxnard Ave., Oxnard, Calif. 93035

[21] Appl. No.: 710,465

[22] Filed: Jun. 5, 1991

[51] Int. Cl.[5] ..... A41D 13/00

[52] U.S. Cl. ..... 2/2; 2/44; 2/46; 2/92; 2/23; 2/267; 2/DIG. 3; 128/DIG. 20

[58] Field of Search ..... 2/2, 44, 46, 69, 92, 2/DIG. 3, DIG. 7, 267, 23; 128/132, DIG. 20

[56] References Cited

U.S. PATENT DOCUMENTS

| | | | |
|---|---|---|---|
| 1,538,538 | 5/1925 | Wood | 155/189 |
| 2,652,183 | 9/1953 | Hlivka | 227/49 |
| 3,008,214 | 11/1961 | Foster et al. | 2/2 |
| 3,708,799 | 1/1973 | Smithdeal | 2/46 |
| 4,151,613 | 5/1979 | Rhee | 2/2 |
| 4,547,919 | 10/1985 | Wang | 2/DIG. 3 |
| 4,568,125 | 2/1986 | Sckolnik | 297/467 |
| 4,666,207 | 5/1987 | Quartano | 297/229 |
| 4,689,829 | 9/1987 | Kaplan | 2/46 |
| 4,735,423 | 4/1988 | Foss | 2/46 |
| 4,737,994 | 4/1988 | Galton | 2/2 |
| 4,837,859 | 6/1989 | Hamberg | 2/2 |
| 4,991,230 | 2/1991 | Vacanti | 2/2 |
| 4,996,721 | 5/1991 | Beshro | 2/19 |
| 5,003,634 | 4/1991 | Brinkman | 2/46 |
| 5,034,998 | 7/1991 | Kolsky | 2/2 |

FOREIGN PATENT DOCUMENTS

| | | | |
|---|---|---|---|
| 1552200 | 7/1968 | France | 2/DIG. 3 |

*Primary Examiner*—Werner H. Schroeder
*Assistant Examiner*—Gloria Hale
*Attorney, Agent, or Firm*—Thomas I. Rozsa

[57] ABSTRACT

The present invention is an inflatable protective cushion to be worn by people in high speed and high impact sports such as snowboarding for cushioning the blow when falling on their rear, or for sitting on as a seat when working on their boot bindings. The inflatable protective cushion comprises a pouch made of flexible and non-stretchable fabric material. The pouch has at least four constricted compartments parallel to one another, each constricted compartment containing an inflatable membrane made of flexible impervious material, where the inflatable membrane is arranged in constricted configuration. The inflatable protective cushion further comprises a valve means for inflating the inflatable membrane and maintaining a desired pressure therein, and means for attaching the pouch to the wearer, such that each of the two opposite hip regions of the wearer's body is overlapped by at least two of the at least four constricted compartments of the pouch.

25 Claims, 2 Drawing Sheets

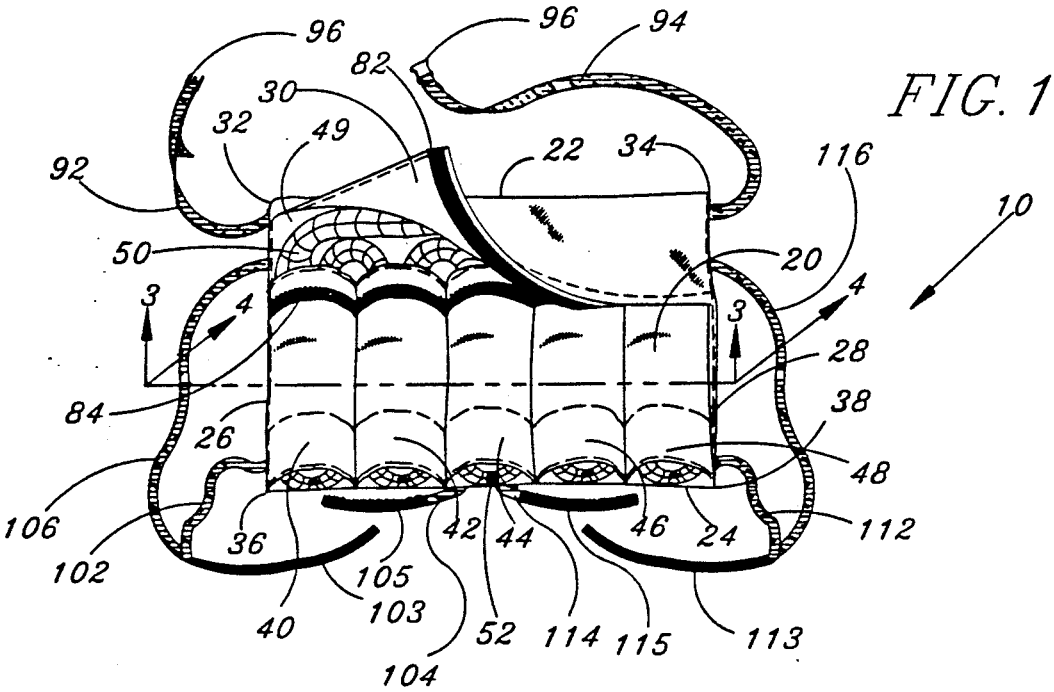
FIG. 1
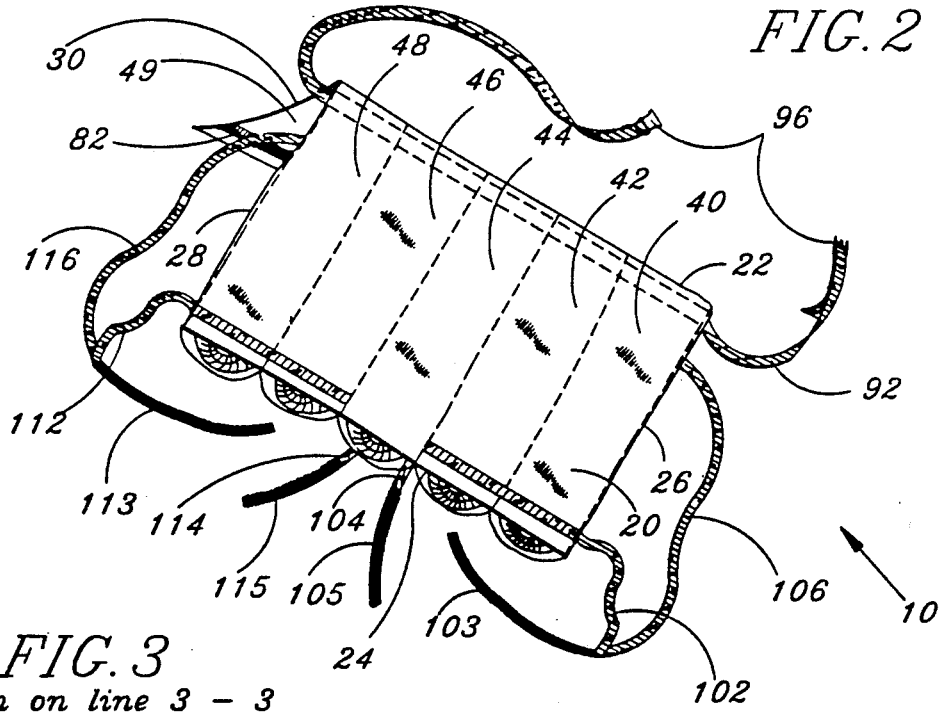
FIG. 2
FIG. 3
Section on line 3 – 3
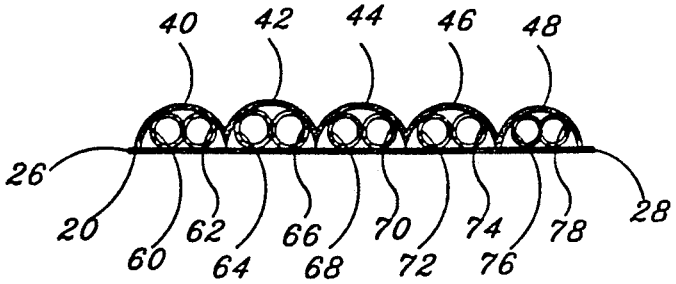

Section on line 4 – 4

INFLATABLE PROTECTIVE CUSHION TO BE WORN BY PEOPLE IN HIGH SPEED AND HIGH IMPACT SPORTS

BACKGROUND OF THE INVENTION

1. Field of the Invention

The present invention relates to the field of protective cushioning devices for high speed and high impact sports. More particularly the present invention relates to the field of cushioning devices for protecting people's lower back body portions in high speed and high impact sports such as snowboarding or the like.

2. Description of the Prior Art

In recent years a new sport—snowboarding—has become more and more popular. Many people have switched to this sport from other traditional sports such as downhill skiing. One special aspect of the new sport of snowboarding is its high speed and high impact. In snowboarding, the player is standing on a snowboard with both feet buckled to the bindings on the top of the snowboard. In use, since both feet are attached together and cannot move relative to each other, the user often falls. Due to the high speed and high impact of the snowboard, people who fall can very easily injure their tailbone. Current protective garments do not provide adequate cushioning for people's rear end when falling down. It is desirable to have a wearable cushioning device for people to wear as an additional protection in snowboarding, or similar sports, such as downhill skiing, rollerblading, ice skating, ice hockey, skateboarding and even skimboarding.

Another problem people experience with snowboarding is that they must unbuckle their boot bindings in order to get on the liftchair, and once they get to the top of the mountain, they must rebuckle the bindings. Since it is hard to rebuckle the boot bindings by standing on one foot, most the snow is often very cold and makes people's clothing get wet, sometimes even soiled. It is again desirable to have a wearable cushioning device for people to sit on when changing their bindings.

It is well known that a cushioning pad with certain firmness can be used for protecting injuries due to falling on one's rear. Traditional cushioning devices often have two types of filling materials: fiber materials such as cotton batting, and foam materials such as open cell reticular foam. Since fiber materials have very low densities, the cushioning device made of fiber material would have to be extremely bulky in order to gain the protection required in sports such as snowboarding. This makes the fiber type of cushions very unattractive and impractical. On the other hand, the foam type of cushions are also impractical because a high density foam would have to be very hard in order to give the required protection.

A more practical approach is to utilize an inflatable core member in a protective cushioning device. An air inflated cushion usually provides more firmness to offset the impact of falling. Also the firmness of an inflatable cushion can be individually adjusted by the user according to their individual needs. An inflatable cushion is the in high speed and high impact sports such as snowboarding.

The following prior art patents are found to be relevant to the present invention:

1. U.S. Pat. No. 4,996,721 issued to Beshro on Mar. 5, 1991 for "Combined Seat Cushion And Baseball Mitten" (hereafter the "Beshro Patent").

2. U.S. Pat. No. 4,991,230 issued to Vacanti on Feb. 12, 1991 for "Shock Absorbing Body Protective Pads" (hereafter the "Vacanti Patent").

3. U.S. Pat. No. 4,737,994 issued to Galton on Apr. 19, 1988 for "Garment For Protecting Wearer Against Bone Fracture" (hereafter the "Galton Patent").

4. U.S. Pat. No. 4,666,207 issued to Quartano on May 19, 1987 for "Child Shopping Cart Cushion" (hereafter the "Quartano Patent").

5. U.S. Pat. No. 4,568,125 issued to Sckolnik on Feb. 4, 1986 for "Child Safety Cushion" (hereafter the "Sckolnik Patent").

6. U.S. Pat. No. 2,652,183 issued to Hlivka on Sept. 15, 1953 for "Baby Holder For Childrens' Chairs" (hereafter the "Hlivka Patent").

7. U.S. Pat. No. 1,538,538 issued to Wood on May 19, 1925 for "Pad For Children's Chairs" (hereafter the "Wood Patent").

8. French Patent No. 1,552,200 issued to Verhons.

The French Patent is entirely in French. From the figures it appears to be a lady's slip 1 having a tubular extension 14 made of two annular thermoplastic boards 8 and 10 and attached to the waistline 5 of the lady's slip 1.

The Wood Patent discloses a pad for children's chairs. The pad has a main back and bottom section 1 and a fold-over section 2. The main section 1 has a multiplicity of straps 8 for attaching it to a chair. The fold-over section 2 has two openings 7 for allowing a child's legs to extend through them. Then the fold-over section 2 is then folded to cover the front of the child and is fastened by a pair of straps 3. The Wood Patent does not utilize an inflatable cushion and is strictly designed for use as a child safety device.

The Hlivka Patent also discloses a baby holder "A" for children's chairs which is similar to the one disclosed in the Wood Patent but has two additional pairs of loops 23, **23*a* and 24, 24*a*** for adjusting the fastening position of the fold-over section.

The Sckolnik Patent discloses a child safety cushion 10 having a back portion 12, two side bolsters 14 and 16, and a seat portion 18. It also has a multiplicity of straps and small snaps for fastening the cushion 10 to a variety of objects and forming a chair-like cushion to firmly support a child. The Sckolnik Patent again does not utilize an inflatable cushion and is strictly designed for use as a child safety device.

The Quartano Patent discloses a child shopping cart cushion having a seat-back portion 10, a chest portion 11 and an interconnecting groin portion 12. It has a multiplicity of Velcro straps for fastening the cushion to a shopping cart. The Quartano Patent also does not utilize an inflatable cushion, and is strictly designed as a child safety device used with a shopping cart.

The Galton Patent discloses a garment for protecting a wearer against bone fracture resulting from accidental falling. It comprises an undergarment 1 having a waist band 1.1 and fabric portions 1.2 extending down from the waistline to cover the hip regions of the body of a wearer, a pocket forming fabric 2 stitched by stitching 3 to the undergarment 1 and forming two opposite pockets 2.1, 2.2 and an interconnecting portion 2.3 where the lower edge 4 of the interconnecting portion 2.3 is left open for serving as the entrance of the two pockets, an inflatable bag 5 of flexible impervious material such as synthetic rubber inserted inside the two pockets to form two cushion pads 5.1 and 5.2 interconnected by a connecting portion 5.3, and means for inflating the inflatable bag 5 such as a valve 6. The Galton Patent utilizes an inflatable bag for its cushioning garment. However, the Galton Patent has some fundamental disadvantages which make it impracticable to be used as protective cushioning device in high speed and high impact sports such as snowboarding.

The Vacanti Patent discloses a shock absorbing body protective pad having a pair of heat sealable members 11 and 12 sealed together to form a multiplicity of chamber elements 19–23. Each chamber element contains a foam pad for cushioning. A multiplicity of rigid tubular exhaust ports 32–37 are arranged to communicate between the chamber elements and the ambient air. The body has a multiplicity of interconnected chambers for receiving inserted pads. The Vacanti Patent pads are made of foam material which are not inflatable, and the firmness of the pads is not adjustable by the user.

The Beshro Patent discloses a combined seat cushion and baseball mitten having two pouches into which pads of foam plastic material are inserted. It can be sat on as a seat cushion or attached to a hand as a baseball mitten. It again utilizes pads made of foam material which are not inflatable, and the firmness of the pads is not individually adjustable.

First of all, none of the prior art patents particularly addressed the problem of protecting one's rear end from injuries due to accidental falling in the new high speed and high impact sports such as snowboarding. Many prior art patents are specially designed for use as child safety devices. There are some special requirements for cushions used for snow related sports. Since people wear heavy clothing, the cushions must be able to be conveniently worn outside of the heavy clothing.

Second and most important, most of the prior art patents utilize fiber or foam materials for their protective cushioning devices, which do not provide adequate protection. Only one of the prior art patents, the Galton Patent, employed an inflatable bag inserted into two pockets and an interconnecting portion for its protective cushioning garment.

However, the Galton Patent has some essential drawbacks which makes it impracticable to be used for high speed and high impact sports such as snowboarding. The Galton Patent cushion has two pockets for an inflatable bag. Each pocket covers one of the two opposite hip regions of the human body. The problem with the Galton Patent cushion is that there is only one large pocket covering one hip region, and the inflatable membrane inserted in that one large pocket is fairly large. Also, the undergarment and the pocket-forming fabric of the Galton Patent cushion are made of stretchable material. Therefore, the air in one portion of the large inflatable membrane is almost free to displace to other portions of the large inflatable membrane. When a wearer of the Galton Patent cushion falls on his or her rear, only a portion of an inflatable membrane of the Galton Patent cushion is directly located at the spot where the wearer's body contacts the ground. Upon impact, the air in that portion of the large inflatable membrane will displace itself into other portions of the same inflatable membrane. This air displacement effect of the Galton Patent cushion cancels a huge amount of cushioning benefit to the wearer portion of the inflatable membrane of the cushion. In addition, the undergarment design of the Galton Patent cushion prevents it from being used as an cushion device worn outside of the skier's heavy clothing.

It is clear that none of the prior art patents has ever addressed the special cushioning need of the high speed and high impact sports such as snowboarding, and none of the prior art patents provides adequate firmness for cushioning the blow of an accidental fall on one's rear. Therefore, there is a significant need for a newly designed and constructed inflatable cushion to be worn by people in high speed and high impact sports such as snowboarding, for cushioning the blow when falling on their rear, or for sitting on a seat when changing their ski bindings.

SUMMARY OF THE PRESENT INVENTION

The present invention is an inflatable protective cushion to be worn by people in high speed and high impact sports such as snowboarding, for cushioning the blow when falling on their rear or for sitting on a seat when working on their boot bindings.

It is understood that a protective cushion for high speed and high impact sports such as snowboarding must have two features: first it needs to be firm enough to withstand the blow of falling; and second it needs to be convenient enough to be worn outside of people's ski clothing. An inflatable cushion provides the firmness required in such sports.

It has been discovered, according to the present invention, that if the cross-sectional area of the inflatable membrane of a cushion is reduced, then it is more difficult for the air inside the inflatable membrane to displace itself from one portion of the inflatable membrane to other portions of the inflatable membrane.

It has also been discovered, according to the present invention, that if the inflatable membrane of a cushion is disposed in a constricted configuration, then the air inside the inflatable membrane is more restricted from displacement from one portion of the inflatable membrane to other portions of the inflatable membrane.

It has again been discovered, according to the present invention, that if the inflatable cushion is constructed such that there is more than one compartment covering each one of the two respective hip regions of the human body, then the firmness of the part of the cushion adjacent to each individual hip region is greatly increased.

It has further been discovered, according to the present invention, that if each compartment of the inflatable cushion has a constricted configuration for its inflatable membrane, then it is much more difficult for the air inside the inflatable membrane to displace itself from one portion of the inflatable membrane to other portions of the inflatable membrane.

It has additionally been discovered, according to the present invention, that if the compartments of the inflatable cushion are made of non-stretchable material, then it is even more difficult for the air inside the inflatable membrane to displace itself from one portion of the inflatable membrane to other portions of the inflatable membrane.

It is therefore an object of the present invention to provide an inflatable protective cushion to be worn by people in high speed and high impact sports, which utilizes inflatable membranes with reduced cross-sectional area, so that it is harder for the air inside the inflatable membrane to displace itself from one portion of the inflatable membrane to other portions of the inflatable membrane.

It is also an object of the present invention to provide an inflatable protective cushion to be worn by people in high speed and high impact sports, wherein the inflatable membrane is disposed in a compartment with constricted configuration, so that the air inside the inflatable membrane is more restricted to displace itself from one portion of the inflatable membrane to other portions of the inflatable membrane.

It is another object of the present invention to provide an inflatable protective cushion to be worn by people in high speed and high impact sports, which is constructed such that there are more than one compartment covering each one of the two respective hip regions of the human body, so that the firmness of the part of the cushion adjacent to each individual hip region is greatly increased.

It is a further object of the present invention to provide an inflatable protective cushion to be worn by people in high speed and high impact sports, where each compartment of the inflatable cushion has a constricted configuration for its inflatable membrane, so that it is much harder for the air inside the inflatable membrane to displace itself from one portion of the inflatable membrane to other portions of the inflatable membrane.

It is an additional object of the present invention to provide an inflatable protective cushion to be worn by people in high speed and high impact sports, where the compartments of the inflatable cushion are made of nonstretchable material, so tat it is even harder for the air inside the inflatable membrane to displace itself from one portion of the inflatable membrane to other portions of the inflatable membrane.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective view of the outer side of the present invention inflatable protective cushion.

FIG. 2 is a perspective view of the inner side of the present invention inflatable protective cushion.

FIG. 3 is a cross-sectional view taken along line 3—3 of FIG. 1.

DETAILED DESCRIPTION OF THE PREFERRED EMBODIMENT

Figure 4:
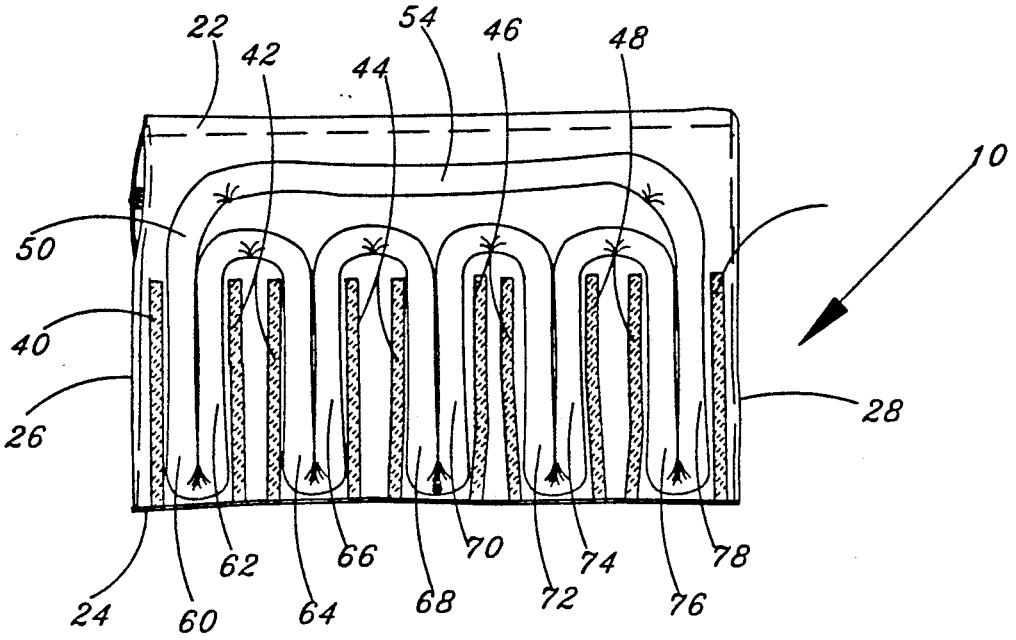
FIG. 4 is a cross-sectional view taken along line 4—4 of FIG. 1.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 1 and 2, there is shown at 10 the present invention inflatable protective cushion. Inflatable protective cushion 10 has a rectangular shaped pouch 20. Rectangular shaped pouch 20 has an upper edge 22, a lower edge 24, a left side edge 26 and a right side edge 28. It also has a left upper corner 32, a right upper corner 34, a left lower corner 36 and a right lower corner 38.

Rectangular shaped pouch 20 is preferably made of flexible, non-stretchable and abrasion resistant nylon or other suitable material Rectangular shaped pouch 20 is flexible, so it can be suitably worn by people on the outside or on the inside of their ski garments. It is also abrasion resistant, so it can be placed on snow or dirt as a seat for people to sit on for tieing and untieing their boot bindings. The importance of the rectangular shaped pouch 20 being non-stretchable will be discussed below.

The essential feature of rectangular shaped pouch 20 is that it has five vertical tubular shaped constricted compartments 40, 42, 44, 46 and 48. All five vertical tubular shaped constricted compartments 40, 42, 44, 46 and 48 are equally sized, and are arranged next to each other and parallel to the left and right side edges 26 and 28 of rectangular shaped pouch 20. There are two major factors which make compartments 40, 42, 44, 46 and 48 constricted compartment is tubular shaped with a small cross-sectional diameter which is less than 2 inches. The second major factor is that the size of each compartment cannot expand in its circumferential direction since rectangular shaped pouch 20 is made of non-stretchable material.

Extending from upper edge 22 of rectangular shaped pouch 20, there is a rectangular shaped cover 30 also made of flexible, non-stretchable and abrasion resistant nylon material. Rectangular shaped cover 30 is folded down to cover the upper openings of the five rectangular shaped constricted compartments 40, 42, 44, 46 and 48, and is closed in position by a lock means which includes a loop type fastening member 82 affixed to rectangular shaped cover 30 and a hook type fastening member 84 affixed to rectangular shaped pouch 20. Of course the fastening members may be other suitable types. When closed, rectangular shaped cover 30 forms a horizontal compartment 49 which interconnects the five vertical tubular shaped constricted compartments 40, 42, 44, 46 and 48. Horizontal compartment 49 is also constricted because rectangular shaped cover 30 is also made of non-stretchable material and the configuration of horizontal compartment 49 is fixed once rectangular shaped cover 30 is closed.

An elongated tubular shaped inflatable membrane 50 is placed in side the five vertical tubular shaped constricted compartments 40, 42, 44, 46 and 48, and horizontal constricted compartment 49. Elongated tubular shaped membrane 50 is made of flexible airtight natural or synthetic rubber material which can bear inner pressure up to 100 pounds per square inch. Its inner cross-sectional diameter is preferably less than 2 inches. Elongated tubular shaped membrane 50 has an air valve means 52, which is used to inflate elongated tubular shaped membrane 50 and maintain a desired pressure therein. The air valve means 52 can also bear pressures up to 100 pounds per square inch. In one of the preferred embodiments of the present invention, elongated tubular shaped inflatable membrane 50 is a 27¼ inch ten speed bicycle tire inner-tube.

Further illustrated in FIGS. 3 and 4, elongated tubular shaped inflatable membrane 50 is contained in the five vertical tubular shaped constricted compartments 40, 42, 44, 46 and 48 and the one horizontal constricted compartment 49 in a manner such that it is woven into the five vertical tubular shaped constricted compartments 40, 42, 44, 46 and 48 through their respective upper openings, so that each vertical tubular shaped constricted compartment contains two folded portions of elongated tubular shaped inflatable membrane 50, and the horizontal constricted compartment 49 contains a straight portion of elongated tubular shaped inflatable membrane 50. As shown in FIGS. 3 and 4, vertical compartment 40 contains two folded portions 60 and 62 of elongated tubular shaped inflatable membrane 50, vertical compartment 42 contains two folded portions 64 and 66 of elongated tubular shaped inflatable membrane 50, vertical compartment 44 contains two folded portions 68 and 70 of elongated tubular shaped inflatable membrane 50, vertical compartment 46 contains two folded portions 72 and 74 of elongated tubular shaped inflatable membrane 50, vertical compartment 48 contains two folded portions 76 and 78 of elongated tubular shaped inflatable membrane 50, and horizontal compartment 49 contains a straight portion 54 of elongated tubular shaped inflatable membrane 50. Since rectangular shaped cover 30 can be easily opened and closed, it is very convenient for a user to access elongated tubular shaped membrane 50 for maintenance or service. The location of air valve means 52 is preferably arranged adjacent to the lower opening of the central vertical tubular constricted compartment 44 for easy access.

Inserted and folded in this manner, it is hard for air contained therein to displace itself from one portion of elongated tubular shaped inflatable membrane 50 to another portion of elongated tubular shaped inflatable membrane 50 because of the folding nodes. For example, it is difficult for air contained in folded portion 64 of elongated tubular shaped inflatable membrane 50 to displace itself to folded portion 66 of elongated tubular shaped inflatable membrane 50 even if both folded portions 64 and 66 are inserted in the same constricted compartment 42, because of the folding node 65 between the two folded portions 64 and 66. Similarly, it is difficult for air contained in folded portion 64 of elongated tubular shaped inflatable membrane 50 to displace itself to folded portion 62 of elongated tubular shaped inflatable membrane 50 because of the folding node 63 between the two folded portions 62 and 64. In addition, since each tubular shaped constricted compartment of rectangular shaped pouch 20 has a very small diameter and a non-stretchable size, the respective folded portions of elongated tubular shaped inflatable membrane 50 inserted therein are tightly fitted when inflated.

This arrangement of elongated tubular shaped inflatable membrane 50 plus the parallel arrangement of the tubular shaped constricted compartments, with the high pressure maintained in the elongated tubular shaped inflatable membrane 50, substantially increases the firmness of inflatable protective cushion 10, such that it can provide adequate cushioning protection for high impact due to accidental falling in high speed and high impact sports such as snowboarding down hill skiing, rollerblading, ice skating, ice hockey, skateboarding and even skimborading.

Figure 5:
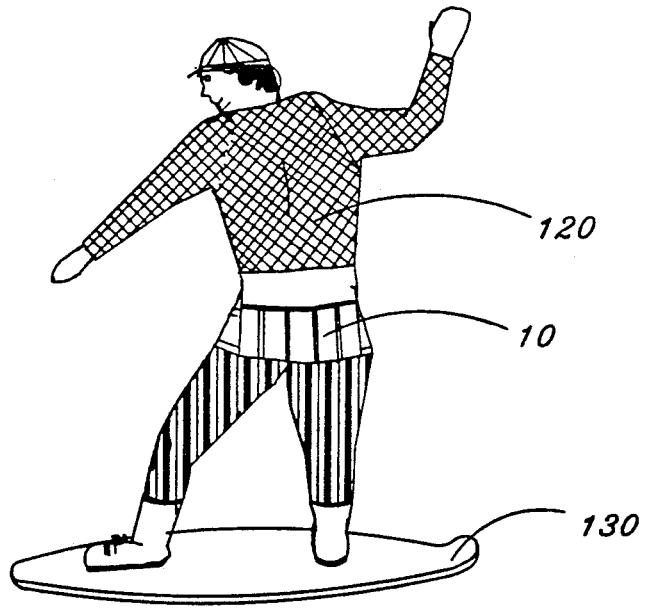
FIG. 5 is an illustration diagram showing the present invention inflatable protective cushion worn by people in snowboarding.

Inflatable protective cushion 10 can be worn by people in the above mentioned sports. It is preferrably worn outside of people's sports garments. However, it may also be worn inside their sports garments. Conveniently provided on inflatable protective cushion 10, there is a belt means including a left belt 92 attached to upper left corner 32 of rectangular shaped pouch 20 and a right belt 94 attached to upper right corner 34 of rectangular shaped pouch 20. Right belt 92 and left belt 94 can be releasably connected together by a suitable releasable connector such as a buckle member 96. Using right and left belts 92 and 94, inflatable protective cushion 10 can be attached to the waist of a wearer 120 who is standing on a snowboard 130, as shown in FIG. 5. The waist region of wearer 120 is overlapped by horizontal constricted compartment 49, and the two opposite hip regions of wearer 120 are overlapped by the five vertical constricted compartments.

Also conveniently provided on inflatable protective cushion 10, there is a left strap means and a right strap means. The left strap means includes a left corner strap 102 attached to lower left corner 36 of rectangular shaped pouch 20 and a left bottom strap 104 attached to lower edge 24 of rectangular shaped pouch 20 at a location adjacent to the middle point of lower edge 24. A loop type fastening member 103 and a hook type fastening member 105 are affixed to left corner strap 102 and left bottom strap 104 respectively, so that left corner strap 102 and left bottom strap 104 can be releasably connected together. Left corner strap 102 and left bottom strap 104 are releasably connected around the left leg of a wearer to attach inflatable protective cushion 10 to the left leg of the wearer, such that the left hip region of the wearer is overlapped by at least the left two vertical tubular shaped constricted compartments 40 and 42. Similarly, the right strap means of inflatable protective cushion 10 includes a right corner strap 112 attached to lower right corner 38 of rectangular shaped pouch 20 and a right bottom strap 114 attached to lower edge 24 of rectangular shaped pouch 20 at a location adjacent to the middle point of lower edge 24. A loop type fastening member 113 and a hook type fastening member 115 are affixed to right corner strap 112 and right bottom strap 114 respectively, so that right corner strap 112 and right bottom strap 114 can be releasably connected together. Right corner strap 112 and right bottom strap 114 are releasably connected around the right leg of a wearer to attach inflatable protective cushion 10 to the right leg of the wearer, such that the right hip region of the wearer is overlapped by at least the right two vertical tubular shaped constricted compartments 46 and 48. As shown in FIG. 5, this arrangement assures that each one of the two opposite hip regions of a wearer is overlapped by at least two constricted compartments, which increases substantially the protection of both of the wearer's hip regions. Of course the hook type and loop type fastening members utilized here may be replaced by any other suitable types of fastening members.

The left strap means further has a left side strap 106 for reinforcing the left strap means, where left side strap 106 is connected between left side edge 26 of rectangular shaped pouch 20 and left corner strap 102. Similarly, the right strap means also has a right side strap 116 for reinforcing the right strap means, where right side strap 116 is connected between right side edge 28 of rectangular shaped pouch 20 and right corner strap 112.

Figure 6:
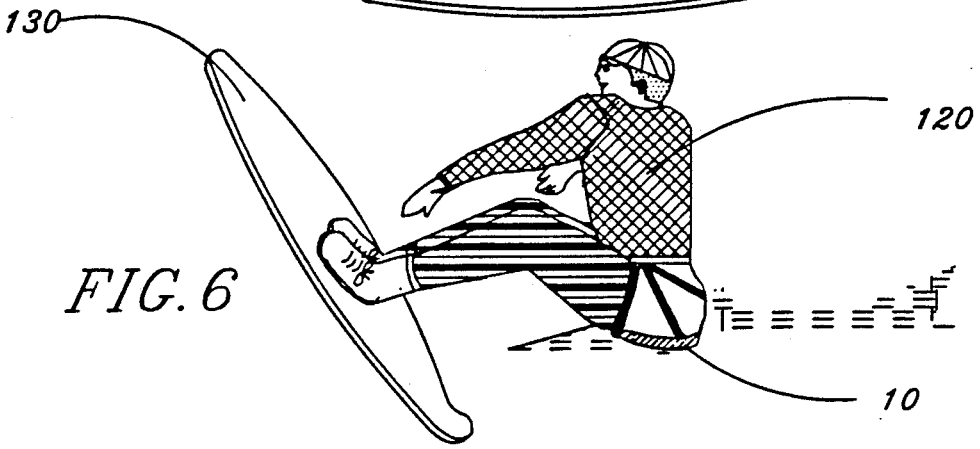
FIG. 6 is an illustration diagram showing the present invention inflatable protective cushion used as a seat for people to sit on when changing ski bindings.

As shown in FIG. 6, the present invention inflatable protective cushion 10 can also be used as a seat to sit on when a wearer 120 needs to work on their boot bindings 132. Inflatable protective cushion 10 will prevent the ski garment of wearer 120 from getting wet or dirty. In addition, when placed on snow, inflatable protective cushion 10 will serve as a thermal insulator between the wearer's body and the snow, so the wearer can be more comfortable when sitting down on the snow.

The present invention inflatable protective cushion 10 has many advantageous features, including: (a) it is firm enough to absorb a high impact blow, since it has two or more folded portions of inflated membrane in each of its constricted compartments, and it has two or more constricted compartments overlapping each hip region of the wearer's body; (b) it is lightweight and is portable in size, which makes it easy to carry and comfortable to wear; (c) it is made of durable abrasion resistant material designed specially to be used as a seat, and when used as seat it further provides thermal insulation; and (d) the pressure of its inflatable membrane is individually adjustable, and its inflatable membrane is easy to access for repair or replacement.

Defined in detail, the present invention is an inflatable protective cushion comprising: (a) a rectangular shaped pouch made of flexible, non-stretchable and abrasion resistant nylon material, the rectangular shaped pouch having a straight upper edge, a straight lower edge, a straight left side edge and a straight right side edge; (b) said rectangular shaped pouch also having an upper left corner, an upper right corner, a lower left corner and a lower right corner; (c) said rectangular shaped pouch further having five vertical tubular shaped constricted compartments, the five vertical tubular shaped constricted compartments being equally sized and arranged next to one another and parallel to said left and right side edges of said rectangular shaped pouch, and each vertical tubular shaped constricted compartment having an upper opening and a lower opening; (d) a rectangular shaped cover made of flexible, non-stretchable and abrasion resistant nylon material, the rectangular shaped cover extending from said upper edge of said rectangular shaped pouch and folding down to cover said upper openings of said five vertical tubular shaped constricted compartments and form a horizontal constricted compartment which interconnects said five vertical tubular shaped constricted compartments; (e) an elongated tubular shaped inflatable membrane made of flexible airtight rubber material, the elongated tubular shaped inflatable membrane being woven into said five vertical tubular shaped constricted compartments through their respective upper openings, such that each vertical tubular shaped constricted compartment contains two folded portions of the elongated tubular shaped inflatable membrane, and said horizontal constricted compartment contains a straight portion of the elongated tubular shaped inflatable membrane; (f) said elongated tubular shaped inflatable membrane further having air valve means for inflating said elongated tubular shaped inflatable membrane and maintaining a desired air pressure therein, the air valve means being located adjacent to said lower opening of a central one of said five vertical tubular shaped constricted compartment for easy access; (g) lock means for closing said rectangular shaped cover to said rectangular shaped pouch; (h) belt means for attaching said rectangular shaped pouch to the waist of the wearer, such that the waist region of the wearer's body is overlapped by said horizontal constrict compartment, and the two opposite hip regions of the wearer's body are overlapped by a portion of said five vertical tubular shaped constricted compartments; (i) said belt means including an elongated left belt attached to said upper left corner of said rectangular shaped pouch and an elongated right belt attached to said upper right corner of said rectangular shaped pouch; (j) left strap means for attaching said rectangular shaped pouch to the left leg of the wearer, such that the left one of the two opposite hip regions of the wearer's body is overlapped by a left pair of said five vertical tubular shaped constricted compartments; (k) said left strap means including a left corner strap attached to said lower left corner of said rectangular shaped pouch, and a left bottom strap attached to said lower edge of said rectangular shaped pouch at a location adjacent to a central point of said lower edge of said rectangular shaped pouch; (j) right strap means for attaching said rectangular shaped pouch to the right leg of the wearer, such that the right one of the two opposite hip regions of the wearer's body is overlapped by a right pair of said five vertical tubular shaped constricted compartments; (m) said right strap means including a right corner strap attached to said lower right corner of said rectangular shaped pouch, and a right bottom strap attached to said lower edge of said rectangular shaped pouch at a location adjacent to the central point of said lower edge of said rectangular shaped pouch; (n) whereby said inflatable protective cushion can be worn by people in high speed and high impact sports such as snowboarding for cushioning the blow when falling on their rear, or for sitting on as a seat when working on their boot bindings.

In one of the preferred embodiments of the present invention inflatable protective cushion defined in detail: (a) the inner cross-sectional diameter of each one of said five vertical tubular shaped constricted compartments is less than 2 inches; (b) the inner cross-sectional diameter of said elongated tubular shaped inflatable membrane is less than 2 inches; (c) the elongated tubular shaped inflatable membrane is a 27¼ inch ten speed bicycle tire inner-tube; (d) the elongated tubular shaped inflatable membrane can bear inner pressures up to 100 pounds per square inch; and (e) the air valve means can maintain pressures in said elongated tubular shaped inflatable membrane up to 100 pounds per square inch.

Also in one of the preferred embodiments of the present invention inflatable protective cushion defined in detail: (a) the lock means comprises a loop type fastening member affixed to said rectangular shaped cover and a hook type fastening member affixed to said rectangular shaped pouch; (b) the belt means further comprises a buckle member; (c) the left strap means further comprises a loop type fastening member affixed to said left corner strap and a hook type fastening member affixed to said left bottom strap; (d) the left strap means further comprises a left side strap attached between said left side edge of said rectangular shaped pouch and said left corner strap for reinforcing said left strap means; (e) the right strap means further comprises a loop type fastening member affixed to said right corner strap and a hook type fastening member affixed to said right bottom strap; and (f) the right strap means further comprises a right side strap attached between said right side edge of said rectangular shaped pouch and said right corner strap for reinforcing said right strap means.

Defined broadly, the present invention is an inflatable protective cushion comprising: (a) a generally rectangular shaped pouch made of flexible, non-stretchable and abrasion resistant fabric material, the generally rectangular shaped pouch having an upper edge, a lower edge and two side edges; (b) said generally rectangular shaped pouch also having two upper corners and two lower corners; (c) said generally rectangular shaped pouch further having five vertical generally tubular shaped constricted compartments, the five vertical generally tubular shaped constricted compartments being arranged next to one another and parallel to said two side edges of said generally rectangular shaped pouch, and each vertical generally tubular shaped constricted compartment having an upper opening; (d) a generally rectangular shaped cover made of flexible, non-stretchable and abrasion resistant fiber material, the generally rectangular shaped cover extending from said upper edge of said generally rectangular shaped pouch and folding down to cover said upper openings of said five vertical generally tubular shaped constricted compartments and forming a horizontal constricted compartment which interconnects said five vertical generally tubular shaped constricted compartments; (e) an elongated generally tubular shaped inflatable membrane made of flexible impervious rubber material, the elongated generally tubular shaped inflatable membrane being woven into said five vertical generally tubular shaped constricted compartments through their respective upper openings, such that each vertical generally tubular shaped constricted compartment contains two folded portions of the elongated generally tubular shaped inflatable membrane, and said horizontal constricted compartment contains a straight portion of the elongated generally tubular shaped inflatable membrane; (f) said elongated generally tubular shaped inflatable membrane further having valve means for inflating said elongated generally tubular shaped inflatable membrane and maintaining a desired air pressure therein; (g) lock means for closing said generally rectangular shaped cover to said rectangular shaped pouch; (h) belt means for attaching said generally rectangular shaped pouch to the waist of the wearer, such that the waist region of the wearer's body is overlapped by said horizontal constricted compartment, and the two opposite hip regions of the wearer's body are overlapped by a portion of said five vertical generally tubular shaped constricted compartments; and (i) strap means for attaching said rectangular shaped pouch to the two legs of the wearer, such that each of the two hip regions of the wearer's body are overlapped by a respective pair of said five vertical generally tubular shaped constricted compartments; (j) whereby said inflatable protective cushion can be worn by people in high speed and high impact sports such as snowboarding for cushioning the blow when falling on their rear, or for sitting on as a seat when working on their boot bindings.

Defined more broadly, the present invention is an inflatable protective cushion comprising: (a) a pouch made of flexible and non-stretchable material; (b) said pouch having at least four constricted compartments parallel to one another; (c) each constricted compartment containing an inflatable membrane made of flexible impervious material, the inflatable membrane being arranged in constricted configuration; (d) valve means for inflating said inflatable membranes and maintaining a desired pressure therein; and (e) fastener means for releasably attaching said pouch to the wearer, such that each of the two opposite hip regions of the wearer's body is overlapped by at least two of said at least four constricted compartments; (f) whereby said inflatable protective cushion can be worn by people in high speed and high impact sports such as snowboarding for cushioning the blow when falling on their rear, or for sitting on as a seat when working on their boot bindings.

Defined most broadly, the present invention is an inflatable protective cushion comprising a multiplicity of non-stretchable compartments each containing a constrictively configured inflatable membrane, whereby the inflatable protective cushion can be worn by people in high speed and high impact sports such as snowboarding for cushioning the blow when falling on their rear, or for sitting on as a seat when working on their boot bindings.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An inflatable protective cushion comprising:

a. a generally rectangular shaped pouch made of flexible, non-stretchable and abrasion resistant fabric material, the generally rectangular shaped pouch having an upper edge, a lower edge and two side edges;

b. said generally rectangular shaped pouch also having two upper corners and two lower corners;

c. said generally rectangular shaped pouch further having five vertical generally tubular shaped constricted compartments, the five vertical generally tubular shaped constricted compartments being arranged next to one another and parallel to said two side edges of said generally rectangular shaped pouch, and each vertical generally tubular shaped constricted compartment having an upper opening;

d. a generally rectangular shaped cover made of flexible, non-stretchable and abrasion resistant fiber material, the generally rectangular shaped cover extending from said upper edge of said generally rectangular shaped pouch and folding down to cover said upper openings of said five vertical generally tubular shaped constricted compartments and forming a horizontal constricted compartment which interconnects said five vertical generally tubular shaped constricted compartments;

e. an elongated generally tubular shaped inflatable membrane made of flexible impervious rubber material, the elongated generally tubular shaped inflatable membrane being woven into said five vertical generally tubular shaped constricted compartments through their respective upper openings, such that each vertical generally tubular shaped constricted compartment contains two folded portions of the elongated generally tubular shaped inflatable membrane, and said horizontal constricted compartment contains a straight portion of the elongated generally tubular shaped inflatable membrane;

f. said elongated generally tubular shaped inflatable membrane further having valve means for inflating said elongated generally tubular shaped inflatable membrane and maintaining a desired air pressure therein;

g. lock means for closing said generally rectangular shaped cover to said rectangular shaped pouch;

h. belt means for attaching said generally rectangular shaped pouch to the waist of the wearer, such that the waist region of the wearer's body is overlapped by said horizontal constricted compartment, and the two opposite hip regions of the wearer's body are overlapped by a portion of said five vertical generally tubular shaped constricted compartments; and i. strap means for attaching said rectangular shaped pouch to the two legs of the wearer, such that each of the two hip regions of the wearer's body is overlapped by a respective pair of said five vertical generally tubular shaped constricted compartments;

j. whereby said inflatable protective cushion can be worn by people in high speed and high impact sports such as snowboarding for cushioning the blow when falling on their rear, or for sitting on as a seat when working on their boot bindings.

2. The invention as defined in claim 1 wherein said elongated generally tubular shaped inflatable membrane is a circular tube.

3. The invention as defined in claim 1 wherein said lock means comprises a loop type fastening member affixed to said generally rectangular shaped cover and a hook type fastening member affixed to said generally rectangular shaped pouch.

4. The invention as defined in claim 1 wherein said belt means comprises two elongated belts attached respectively to said two upper corners of said generally rectangular shaped pouch, where the two elongated belts can be releasably connected together.

5. The invention as defined in claim 4 wherein said belt means further comprises a buckle member.

6. The invention as defined in claim 1 wherein said strap means comprises two corner straps attached said two lower corners of said generally rectangular shaped pouch respectively, and two bottom straps attached to said lower edge of said generally rectangular shaped pouch, where the two corner straps can be releasably connected to the two bottom straps respectively.

7. The invention as defined in claim 6 wherein said strap means further comprises two loop type fastening members affixed to said two corner straps respectively and two hook type fastening members affixed to said two bottom straps respectively.

8. The invention as defined in claim 6 wherein said strap means further comprises two side straps attached between said two side edges of said generally rectangular shaped pouch and said two corner straps respectively for reinforcing said strap means.

9. An inflatable protective cushion comprising:

a. a rectangular shaped pouch made of flexible, nonstretchable and abrasion resistant nylon material, the rectangular shaped pouch having a straight upper edge, a straight lower edge, a straight left side edge and a straight right side edge;

b. said rectangular shaped pouch also having an upper left corner, an upper right corner, a lower left corner and a lower right corner;

c. said rectangular shaped pouch further having five vertical tubular shaped constricted compartments, the five vertical tubular shaped constricted compartments being equally sized and arranged next to one another and parallel to said left and right side edges of said rectangular shaped pouch, and each vertical tubular shaped constricted compartment having an upper opening and a lower opening;

d. a rectangular shaped cover made of flexible, nonstretchable and abrasion resistant nylon material, the rectangular shaped cover extending from said upper edge of said rectangular shaped pouch and folding down to cover said upper openings of said five vertical tubular shaped constricted compartments and form a horizontal constricted compartment which interconnects said five vertical tubular shaped constricted compartments;

e. an elongated tubular shaped inflatable membrane made of flexible airtight rubber material, the elongated tubular shaped inflatable membrane being woven into said five vertical tubular shaped constricted compartments through their respective upper openings, such that each vertical tubular shaped constricted compartment contains two folded portions of the elongated tubular shaped inflatable membrane, and said horizontal constricted compartment contains a straight portion of the elongated tubular shaped inflatable membrane;

f. said elongated tubular shaped inflatable membrane further having air valve means for inflating said elongated tubular shaped inflatable membrane and maintaining a desired air pressure therein, the air valve means being located adjacent to said lower opening of a central one of said five vertical tubular shaped constricted compartment for easy access;

g. lock means for closing said rectangular shaped cover to said rectangular shaped pouch;

h. belt means for attaching said rectangular shaped pouch to the waist of a wearer, such that the waist region of the wearer's body is overlapped by said horizontal constrict compartment, and the two opposite hip regions of the wearer's body are overlapped by a portion of said five vertical tubular shaped constricted compartments;

i. said belt means including an elongated left belt attached to said upper left corner of said rectangular shaped pouch and an elongated right belt attached to said upper right corner of said rectangular shaped pouch;

j. left strap means for attaching said rectangular shaped pouch to the left leg of the wearer, such that the left one of the two opposite hip regions of the wearer's body is overlapped by a left pair of said five vertical tubular shaped constricted compartments;

k. said left strap means including a left corner strap attached to said lower left corner of said rectangular shaped pouch, and a left bottom strap attached to said lower edge of said rectangular shaped pouch at a location adjacent to a central point of said lower edge of said rectangular shaped pouch;

l. right strap means for attaching said rectangular shaped pouch to the right leg of the wearer, such that the right one of the two opposite hip regions of the wearer's body is overlapped by a right pair of said five vertical tubular shaped constricted compartments; and m. said right strap means including a right corner strap attached to said lower right corner of said rectangular shaped pouch, and a right bottom strap attached to said lower edge of said rectangular shaped pouch at a location adjacent to the central point of said lower edge of said rectangular shaped pouch;

n. whereby said inflatable protective cushion can be worn by people in high speed and high impact sports such as snowboarding for cushioning the blow when falling on their rear, or for sitting on as a seat when working on their boot bindings.

10. The invention as defined in claim 9 wherein the inner cross-sectional diameter of each one of said five vertical tubular shaped constricted compartments is less than 2 inches.

11. The invention as defined in claim 9 wherein the inner cross-sectional diameter of said elongated tubular shaped inflatable membrane is less than 2 inches.

12. The invention as defined in claim 9 wherein said elongated tubular shaped inflatable membrane is a 27½ inch ten speed bicycle tire inner-tube.

13. The invention as defined in claim 9 wherein said elongated tubular shaped inflatable membrane can bear inner pressures up to 100 pounds per square inch.

14. The invention as defined in claim 9 wherein said air valve means can maintain pressures in said elongated tubular shaped inflatable membrane up to 100 pounds per square inch.

15. The invention as defined in claim 9 wherein said lock means comprises a loop type fastening member affixed to said rectangular shaped cover and a hook type fastening member affixed to said rectangular shaped pouch.

16. The invention as defined in claim 9 wherein said belt means further comprises a buckle member.

17. The invention as defined in claim 9 wherein said left strap means further comprises a loop type fastening member affixed to said left corner strap and a hook type fastening member affixed to said left bottom strap.

18. The invention as defined in claim 9 wherein said left strap means further comprises a left side strap attached between said left side edge of said rectangular shaped pouch and said left corner strap for reinforcing said left strap means.

19. The invention as defined in claim 9 wherein said right strap means further comprises a loop type fastening member affixed to said right corner strap and a hook type fastening member affixed to said right bottom strap.

20. The invention as defined in claim 9 wherein said right strap means further comprises a right side strap attached between said right side edge of said rectangular shaped pouch and said right corner strap for reinforcing said right strap means.

21. An inflatable protective cushion comprising:

a. a pouch made of flexible and non-stretchable material;

b. said pouch having at least four constricted compartments parallel to one another;

c. each constricted compartment containing an inflatable membrane made of flexible impervious material, the inflatable membrane being arranged in constricted configuration;

d. valve means for inflating said inflatable membrane and maintaining a desired pressure therein; and e. fastener means for releasably attaching said pouch to a wearer, such that each of the two opposite hip regions of the wearer's body is overlapped by at least two of said at least four constricted compartments;

f. whereby said inflatable protective cushion can be worn by people in high speed and high impact sports such as snowboarding for cushioning the blow when falling on their rear, or for sitting on as a seat when working on their boot bindings.

22. The invention as defined in claim 21 wherein said fastener means comprises waist belts for releasably attaching said pouch to the waist of a wearer.

23. The invention a defined in claim 22 wherein said fastener means further comprises leg straps for releasably attaching said pouch to the legs of a wearer.

24. An inflatable protective cushion comprising a multiplicity of non-stretchable compartments each containing a constrictively configured inflatable membrane, whereby the inflatable protective cushion can be worn by people in high speed and high impact sports such as snowboarding for cushioning the blow when falling on their rear, or for sitting on as a seat when working on their boot bindings.

25. The invention as defined in claim 24 further comprising means for inflating said inflatable membrane and maintaining a desired pressure therein.

* * * * *